US010710372B2

(12) United States Patent
Cobb et al.

(10) Patent No.: US 10,710,372 B2
(45) Date of Patent: Jul. 14, 2020

(54) WIPING NOZZLES OF FLUID EJECTION DIES

(71) Applicant: Hewlett-Packard Development Company, L.P., Spring, TX (US)

(72) Inventors: Rachelle Hea Cobb, Vancouver, WA (US); Teressa L Roth, Vancouver, WA (US); Dimitre Lalov Staykov, Vancouver, WA (US); Weiyun Sun, Vancouver, WA (US); Christie D Larson, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/337,065

(22) PCT Filed: Oct. 5, 2016

(86) PCT No.: PCT/US2016/055475
§ 371 (c)(1),
(2) Date: Mar. 27, 2019

(87) PCT Pub. No.: WO2018/067138
PCT Pub. Date: Apr. 12, 2018

(65) Prior Publication Data

US 2020/0031129 A1 Jan. 30, 2020

(51) Int. Cl.

| | |
|---|---|
| ***B41J 2/165*** | (2006.01) |
| ***B41J 29/393*** | (2006.01) |
| *B41J 2/14* | (2006.01) |
| *B41J 2/21* | (2006.01) |

(52) U.S. Cl.
CPC ..... *B41J 2/16535* (2013.01); *B41J 29/393* (2013.01); *B41J 2/14024* (2013.01); *B41J 2/2146* (2013.01); *B41J 2002/1655* (2013.01); *B41J 2002/16558* (2013.01)

(58) Field of Classification Search
CPC ..... B41J 2/16535; B41J 2/16505; B41J 2/16508; B41J 2/16517; B41J 2/16544; B41J 2/16547; B41J 2002/1655; B41J 2002/16558
See application file for complete search history.

(56) References Cited

U.S. PATENT DOCUMENTS

| | | | |
|---|---|---|---|
| 5,103,244 | A | 4/1992 | Gast et al. |
| 5,847,727 | A | 12/1998 | VanLiew et al. |
| 6,017,110 | A | 1/2000 | Jackson |
| 6,244,685 | B1 | 6/2001 | Yamada et al. |
| 2008/0024537 | A1 | 1/2008 | Park |
| 2008/0266342 | A1 | 10/2008 | Steinfield |
| 2009/0128593 | A1 | 5/2009 | Jorba et al. |
| 2010/0283809 | A1 | 11/2010 | Bastani et al. |
| 2011/0102500 | A1 | 5/2011 | Miyazawa |
| 2011/0128321 | A1 | 6/2011 | Sole Pons et al. |
| 2015/0158302 | A1 | 6/2015 | Shinoto et al. |
| 2016/0023457 | A1 | 1/2016 | Hatao |

*Primary Examiner* — Scott A Richmond
(74) *Attorney, Agent, or Firm* — Brooks Cameron & Huebsch PLLC

(57) ABSTRACT

Example implementations relate to wiping die nozzles of fluid ejection dies. For example, a printing device may be directed by execution of stored instructions to eject a droplet in a first direction from an opening in a die nozzle toward a location of an absorbent wipe material and to wipe the opening concurrently with the droplet being ejected from the opening.

15 Claims, 6 Drawing Sheets

WIPING NOZZLES OF FLUID EJECTION DIES

BACKGROUND

Some printing device implementations may maintain and/or clean their fluid ejection die nozzles by performing wipes thereof during idle times in which the nozzles are not being used for print operations. Such an implementation may allow a wipe material to dry between nozzle maintenance and/or clean operations. However, printing device implementations with a higher print output may prompt nozzle maintenance and/or clean operations to be performed at times other than during the idle times.

DETAILED DESCRIPTION

Figure 1:
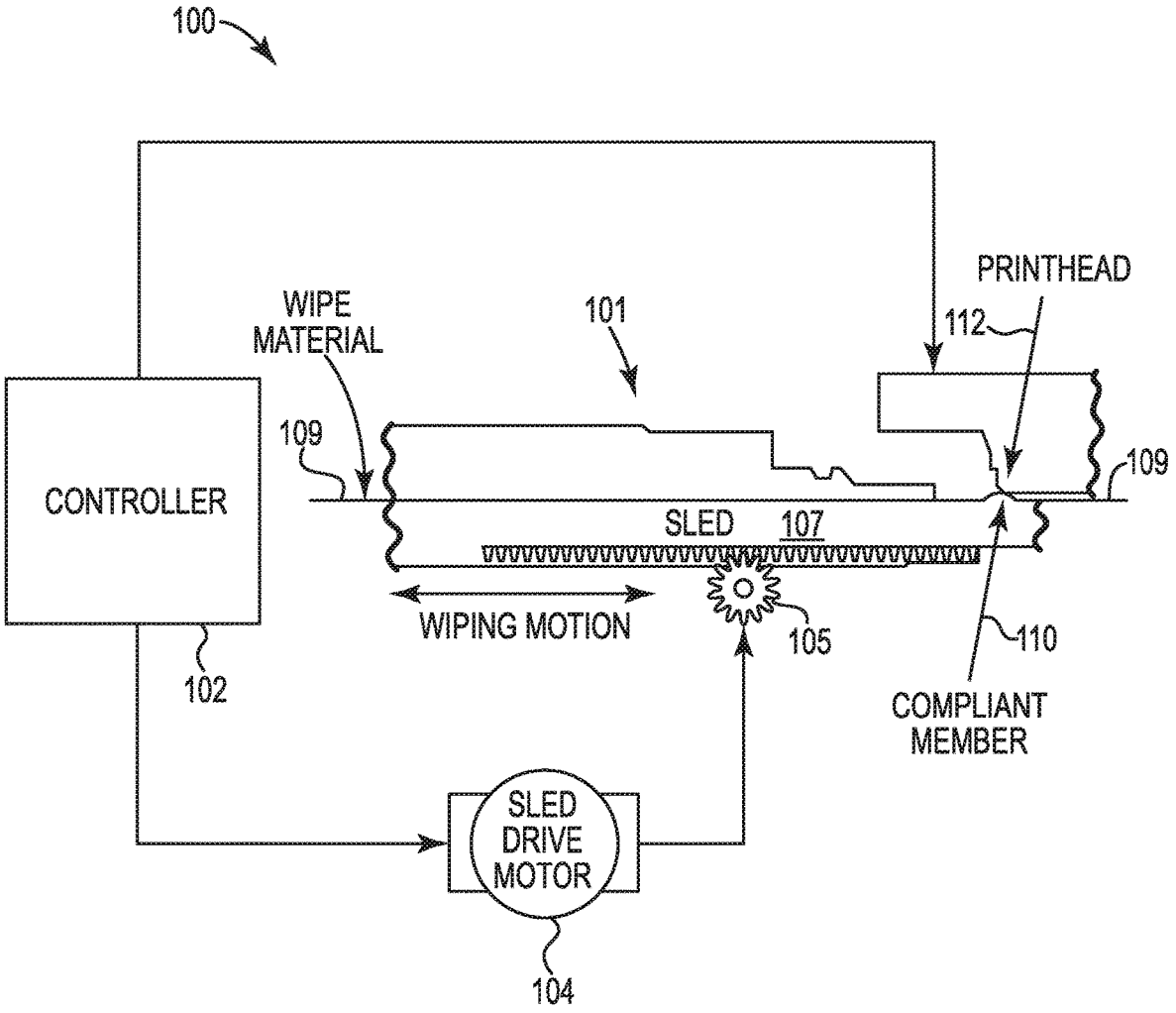
FIG. 1 illustrates a diagram of an example system for wiping nozzles of fluid ejection dies, according to the present disclosure.

Maintenance and/or clean operations may, in some implementations, be scheduled for around every 120 pages having been printed using the nozzles of a fluid ejection die, referred to as a "die" herein. A fixed amount of wipe material may be available within the printing device and, therefore, the wipe material may be re-used multiple times to last the life of the printing device, e.g., around 150,000 pages.

When a die nozzle is wiped multiple times on a same spot, e.g., location, of an absorbent wipe material, e.g., a web of textile, the web may become saturated. The capillary draw of a fluid, e.g., residual dissolved coloring material (ink) and/or partially hardened ink, from the die nozzle may be decreased and/or air may be introduced into an opening of the die nozzle. When fluid, e.g., ink, is subsequently ejected from the opening of the die nozzle after the opening of the die nozzle has been wiped as part of the die nozzle maintenance and/or clean operation sequence, the residual fluid and/or the introduced air may block the die nozzle and reduce efficacy of the die nozzle maintenance and/or clean operation. The blocked die nozzles may affect ejection of fluid, e.g., a reduction in fluid volume and/or deviation in the direction of ejection, during a subsequent print operation, which may appear as print quality defects.

Printing device implementations with a high print output may have a protocol that directs performance of die nozzle maintenance and/or clean operations during a period of active printing, as opposed to an idle time, when reduced performance of the die nozzles is more likely to be seen on print output. The present disclosure is directed to a change in the sequence of fluid ejection from die nozzle openings and wiping of the die nozzle openings during maintenance and/or clean operations. Hence, the sequence described herein may include ejecting fluid, e.g., ejecting a droplet from an opening of a die nozzle, onto an absorbent wipe material, e.g., the web, while concurrently wiping the opening of the die nozzle.

For example, a printing device may be directed by a controller, e.g., by execution of stored instructions, to eject a droplet in a first direction from an opening in a die nozzle toward a location of an absorbent wipe material and to wipe the opening concurrently with the droplet being ejected from the opening. Such a die nozzle maintenance and/or clean operation may notably reduce occurrence of air being introduced into the die nozzle opening and/or reduction in performance of fluid ejection by the die nozzles compared to wiping the die nozzle and subsequently ejecting fluid from the die nozzle.

In the sequence described herein, the opening of the die nozzle may eject a droplet of fluid, e.g., of ink, while the opening of the die nozzle is in contact with the absorbent wipe material, e.g., web. In addition, the present disclosure describes that more than one droplet may be ejected on a same location of the web. For example, each successive ejection of a droplet on the same location incrementally increases the wetness of the location. Wiping the opening of the die nozzle with the web location concurrently with the droplets being ejected thereon while increasing the wetness. Wiping with the increasingly wet location may progressively contribute to reduction of air being introduced into the die nozzle openings. This is a paradigm shift in wiping relative to other printers because it is an unexpected result that adding wetness to an already wet web, via ejecting fluid more than once on the same location on the web, may reduce introduction of air into the die nozzle and/or may improve performance of subsequent print operations using the die nozzle.

FIG. 1 illustrates a diagram of an example system for wiping nozzles of dies, according to the present disclosure. As illustrated in FIG. 1, the system 100 may include a printing device 101 and a controller 102. The controller 102 may direct execution of operations performed by and/or on the printing device 101, including wiping openings of nozzles of dies, e.g., an opening 338 of a nozzle 337 of a die 331 as shown in a side-view cross-section and described in connection with FIG. 3. The controller 102 may direct execution, e.g., via a processing resource 542 as shown in and described in connection with FIG. 5, of non-transitory instructions stored in a machine readable medium, e.g., as shown at 544 and described in connection with FIG. 5. The machine readable medium, in various examples, may be or may include hardware, firmware, and/or software.

The controller 102 may direct die nozzle maintenance and/or clean operations performed on dies positioned in a printhead 112 of the printing device 101. For example, a die 331 in the printhead 112 may be directed to eject a droplet of fluid through the opening 338 of the die nozzle 337, e.g., via activation of a fluid ejector, such as a thermal resistor, to form a bubble in proximate fluid. The droplet of fluid may be ejected toward a wipe material 109, e.g., an absorbent wipe material as also shown at 209 and described in connection with FIG. 2.

The controller 102 may further direct ejection of a droplet from the opening 338 in each of a plurality of die nozzles 337 toward a location of the absorbent wipe material 109, e.g., a predetermined position on a surface of the absorbent wipe material. The controller 102 may further direct a wipe of the opening 338 in each die nozzle 337 by the location concurrently with the droplet being ejected from the opening 338, along with transit of the location past the opening in each die nozzle as the droplet is ejected from the opening. As such, the droplet may be at the location at a time that the opening is being wiped by the location.

In some examples, the controller 102 may further direct that ejection of the droplet from the opening 338 toward the location of the absorbent wipe material 109 be coordinated with the transit of the absorbent wipe material causing the predetermined position on the surface of the absorbent wipe material to reach the opening 338 at the time of droplet ejection therefrom. The controller 102 may further direct that the opening 338 of each die nozzle 337 ejects a determined number of droplets during an ejection, e.g., in a range of from 1 to 100 droplets, for each nozzle maintenance and/or clean operation. The controller 102 may further direct that the location on the absorbent wipe material 109 performs a plurality of wipes, e.g., in a range of from 4 to 100 wipes, corresponding to the number of ejections from the opening on the location. As such, the location on the absorbent wipe material 109 may remain wet after a first ejection of fluid on the location during the performance of the subsequent plurality of ejections on the location and/or wipes by the location.

The controller 102 may further direct that openings 338 of the die nozzles 337 be uncapped prior to performance of a nozzle maintenance and/or clean operation and recapped after performance of the nozzle maintenance and/or clean operation, as described herein. The controller 102 may further direct performance of the nozzle maintenance and/or clean operation after openings 338 of the die nozzles 337 have remained capped for a period of time, e.g., in a range of from 2 minutes to 120 minutes since being capped.

FIG. 1 illustrates a sled 107 and a sled drive motor 104 to transit the absorbent wipe material 109 past the printhead 112. In some examples, the absorbent wipe material 109 may be supported on and/or moved by a movable sled 107 of the printing device 101. The controller 102 may, for example, direct movement of the sled 107 and/or the absorbent wipe material 109 relative to the printhead 112 using the sled drive motor 104. In some examples, the sled drive motor 104 may enable a wiping motion of the sled 107 and/or the absorbent wipe material 109 through a gear arrangement 105, e.g., a rack and pinion as shown in FIG. 1, among other possible arrangements. Alternatively or in addition, the wiping motion of the absorbent wipe material 109 may be enabled by a roller arrangement (not shown). For example, there may be a roller at each end of the printing device 101 being respectively controlled to roll out and roll up the absorbent wipe material 109 to achieve the directed wiping motion.

Figure 3:
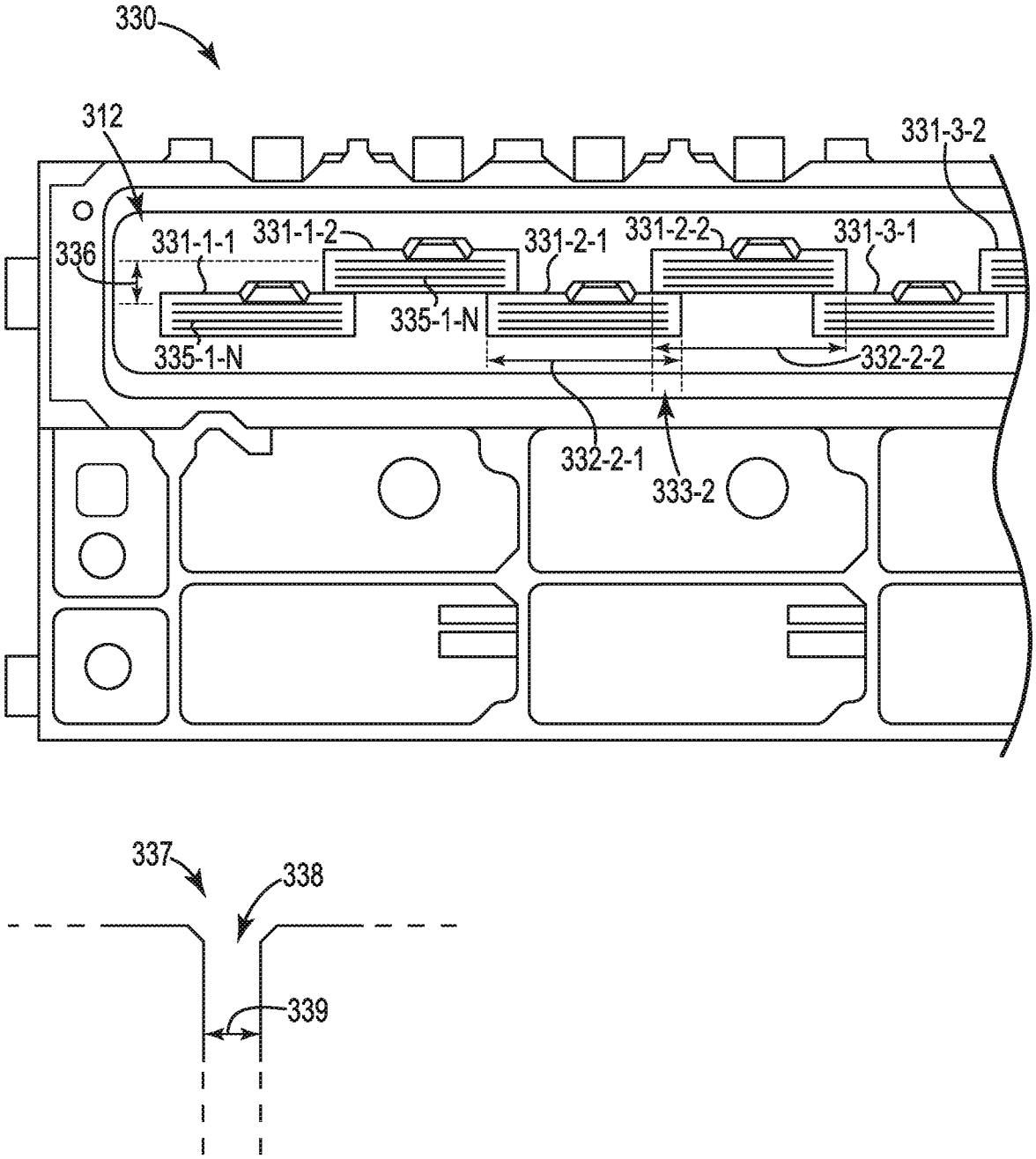
FIG. 3 is a block diagram of an example staggered array of fluid ejection dies, according to the present disclosure.

In various examples, the wiping motion of the absorbent wipe material 109 may be to the left or to the right relative to the printhead 112 shown in FIG. 1. The absorbent wipe material 109 may be moved to the left at some times and may be moved to the right at other times. The wiping motion of the absorbent wipe material 109 may, in some examples, be implemented by moving the printhead 112 relative to the absorbent wipe material 109, e.g., instead of or in addition to the absorbent wipe material 109 being moved relative to the printhead. The absorbent wipe material 109 moving horizontally and/or diagonally across the dies 331 of the printhead 312 shown in FIG. 3 is also within the scope of the present disclosure. The present disclosure refers to one printhead for simplicity, e.g., as shown at 112 in FIGS. 1 and 312 in FIG. 3. However, examples are not limited to one printhead. Any number of printheads, in various configurations, are within the scope of the present disclosure.

Figure 4:
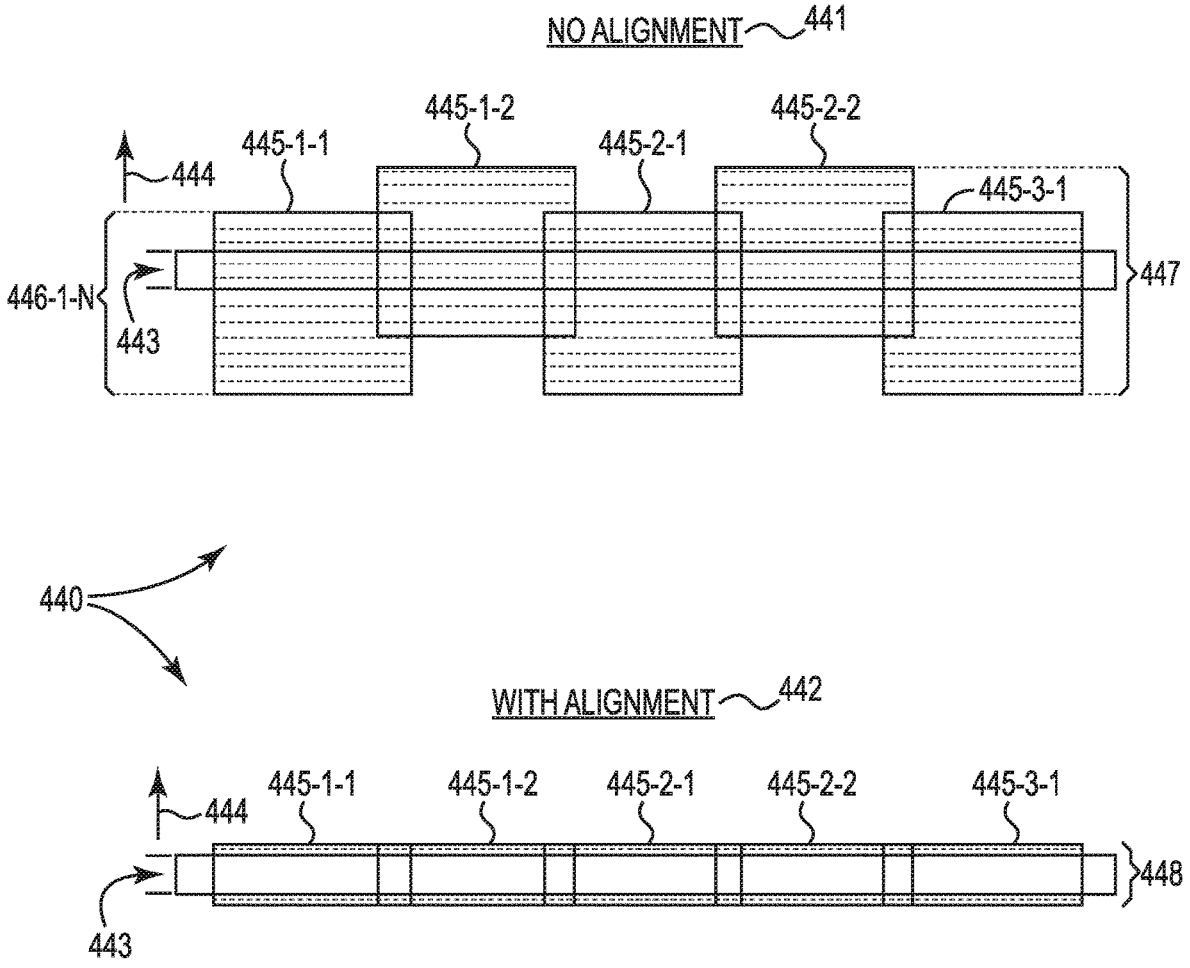
FIG. 4 illustrates an example of droplet alignment on an absorbent wipe material, according to the present disclosure.

FIG. 1 illustrates a compliant member 110 associated with the sled 107. The compliant member 110 may be positioned to press a length of the absorbent wipe material 109 against the printhead 112. The length of the compliant member 110, e.g., corresponding to the position 443 shown in and described in connection with FIG. 4, is intended to be in a direction parallel to a direction of transit, e.g., movement, of the absorbent wipe material 109 past the plurality of die nozzles in the printhead 112. The compliant member 110 may, in various examples, be formed to actively press, e.g., by being spring loaded, and/or to passively press, e.g., by being elastic, the length of the absorbent wipe material 109 against the printhead 112.

The compliant member 110 may be positioned at a stable position relative to the printhead 112 such that a length on the absorbent wipe material 109 is continuously positioned adjacent a die 331 in a row of dies, e.g., as shown in and described in connection with FIG. 3. The position of the compliant member 110 may be stabilized by the compliant member 110 being positioned and/or attached separately from, e.g., not connected to, the movable sled 107 with which the compliant member 110 may be associated.

The length of the compliant member 110 being pressed against the printhead may correspond to the length of the dies 331 in the direction parallel to the direction of transit. The length of the compliant member 110 and/or the absorbent wipe material 109 being pressed against the dies may, in some examples, be in a range of from two millimeters (mm) to 10 mm. The location on the absorbent wipe material 109 toward which the droplet is ejected from the opening 337 of the die nozzle 338 while the opening is concurrently in contact with and/or being wiped by the location may be within the length of the compliant member 110, as further described in connection with FIG. 4.

Figure 2:
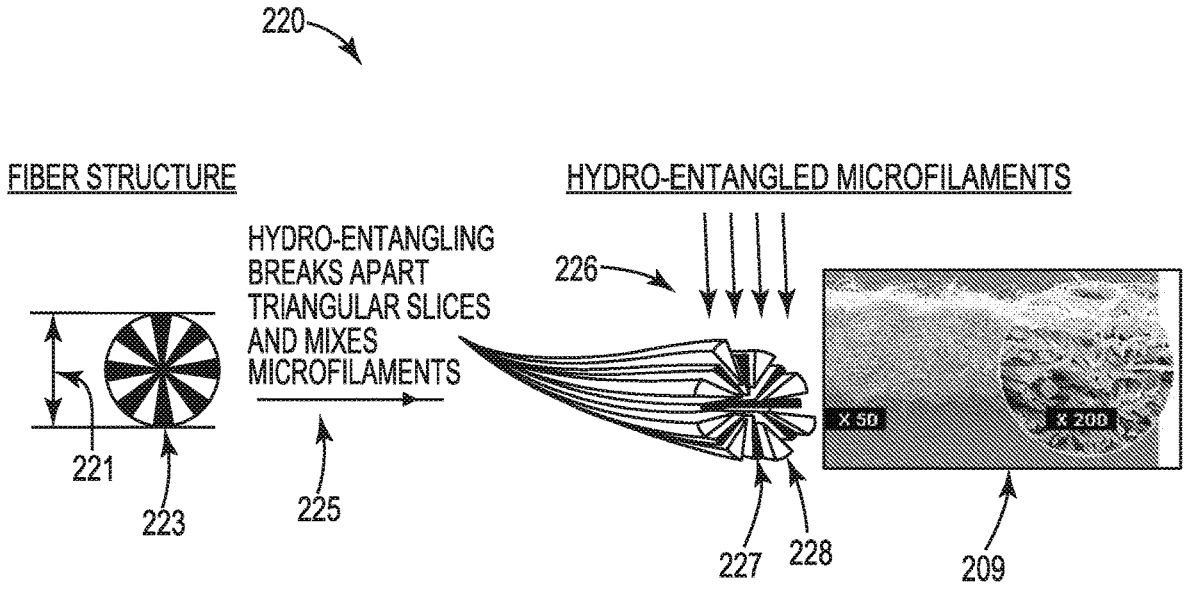
FIG. 2 illustrates a diagram of an example absorbent wipe material, according to the present disclosure.

FIG. 2 illustrates a diagram of an example absorbent wipe material, according to the present disclosure. The diagram shows an example 220 of how an absorbent wipe material 209, as described herein, may be formed. Formation of the absorbent wipe material 209 may include a fiber structure 223 having a predefined diameter 221. In some examples, the fiber structure 223 may have a round cross-section that includes a number of fiber sections that resemble triangular pie slices that in combination form the round cross-section. The illustrated fiber structure 223 shows 16 of these fiber sections by way of example and not by way of limitation. The fiber structure 223 may, in various examples, have a diameter 221 in a range of from 10 micrometers (um) to 30 um and the fiber sections may be formed as slices of alternating polymers. For example, the dark slices may be formed from a polyamide, e.g., nylon, among others, and the light slices may be formed from a polyester, e.g., polyethylene terephthalate, among others. An example of such a fiber structure 223 is Evolon® marketed by the Freudenberg Group, although other such fiber structures are usable and are within the scope of the present disclosure.

The fiber structure 223 may be subject to hydro-entangling 225 to break apart, e.g., dissociate, the triangular slices into microfilaments and mix, e.g., entangle, the microfilaments. For example, high pressure jets 226 of a liquid, e.g., water, among other liquids, may be applied to the fiber structure 223 to dissociate the polyamide slices 227 from the polyester slices 228. The respective microfilaments may be entangled by the high pressure jets 226 into a textile layer, e.g., web, usable as the absorbent wipe material 209 described herein. Each of the polyamide and polyester microfilaments may, in some examples, have a diameter, e.g., a radius from the point of the slice to its opposite arc, in a range of from 4 um to 15 um.

The web may be used as the layer of absorbent wipe material shown at 109 and described in connection with FIG. 1. The dimensions of the web may be suitable for a size of a printing device 101 and/or a frequency of maintenance and/or clean operations using the web, among other considerations. For example, a width of the web, perpendicular to a direction of transit of the absorbent wipe material past the plurality of die nozzles, may correspond to at least a width of the plurality of die nozzles of the printhead, e.g., as shown for the printhead 312 and dies 331 described in connection with FIG. 3. Such a width may allow for all the openings in die nozzles of a row of dies to eject liquid essentially simultaneously toward their own respective location on the web. Accordingly, the web may have a width in a range of from 20 centimeters (cm) to 60 cm, A width of a plurality of locations on the web wetted by ejecting liquid essentially simultaneously from all the openings in the nozzles of the row of the dies may correspond to a width of the row of dies, e.g., a width of the plurality of die nozzles. In some examples, the width of the plurality of die nozzles also may correspond to a width of a print medium, e.g., a width of a page or several horizontally positioned pages, upon which an image is to be printed.

In some examples, the web described herein may be utilized in a "once-through" implementation. For example, a location on the web may be re-used by more than one droplet or more than one sequence of droplets being ejected from a single opening in a die nozzle or a plurality of die nozzle openings onto the particular web location, as described herein. However, in the once-through implementation, when the maintenance and/or clean operation on those die nozzle openings is completed, the web may progress, e.g., by being moved by the sled and/or rollers, such that an unused portion of the web may be used for a next maintenance and/or clean operation performed on the die nozzle openings. In some examples, the web may progress such that half a location that was wetted in a previous operation is half in a next location and half of the next location is unused. e.g., dry. The web may progress from one end to the other end in a same direction, e.g., as determined by the instructions provided by the controller 102 to the sled drive motor 104 for the wiping motion of the sled 107 and/or to the roller arrangement (not shown). In such a once-through implementation of the web, the web may have a length, parallel to the direction of transit of the absorbent wipe material past the plurality of die nozzles, in a range of from 1 meter (m) to 6 m.

FIG. 3 is a block diagram of an example staggered array 330 of dies 331 in a printhead 312, according to the present disclosure. In some examples, the printhead 312 may include a staggered array 330 array of a plurality of dies 331 on a plane. Each die, e.g., dies 331-1-1, 331-1-2, . . . , 331-3-1, among other dies, may include a subset of a plurality of die nozzles, e.g., die nozzle 337 shown in a side-view cross-section. For example, each die 331 may include a plurality of separate sequences, e.g., rows, of die nozzles. The plurality of sequences of die nozzles are represented by reference number 335-1-N for die pair 331-1-1 and 331-1-2. The plurality of sequences 335-1-N of die nozzles in each die 331 may be four, as shown in FIG. 3, although embodiments are not so limited. In some examples, the different sequences 335-1-N of die nozzles in each die may each correspond to a different type of fluid, e.g., a different ink color, that may be ejected from the openings, e.g., opening 338, of the die nozzles in that sequence.

The dimensions of each die may be a width in a range of from 10 mm to 100 mm perpendicular to a direction of transit of the absorbent wipe material past the plurality of die nozzles and a length in a range of 2 mm to 20 mm parallel to the direction of transit. The number of die nozzles per sequence 335, e.g., per different type of fluid and/or different ink color, may be in a range of from 200 to 5000 die nozzles. In various examples, one nozzle for a particular sequence, e.g., type of fluid and/or ink color, may be ejecting at a time, e.g., one nozzle in a single die or one nozzle in each of a plurality of dies, up through all nozzles corresponding to a particular sequence across the width of the plurality of die nozzles of the printhead ejecting substantially simultaneously, and any other grouping of the nozzles.

The plurality of staggered dies, e.g., each having a plurality of sequences 335-1-N of die nozzles, may extend in a direction perpendicular to the direction of transit such that an end of a first die, e.g., die 331-2-1, in a first row overlaps 333-2 with a first end of a second die, e.g., die 331-2-2, in a second row in a direction parallel to the direction of transit. A second end of the second die, e.g., die 331-2-2, may overlap with an end of a third die, e.g., die 331-3-1, in the first row in the direction parallel to the direction of transit. The overlap 333-2 of the staggered dies in the first row with the dies in the second row may be in a range of from 1 mm to 10 mm, with a corresponding overlap of the die nozzles in the die in the first row with the die nozzles in the die in the second row. In some examples, the die nozzles in the first row and the die nozzles in the second row may be aligned in the overlap 333-2 in the direction parallel to the direction of transit. The number of rows of dies is shown to be two rows for clarity, although the number of rows is not so limited.

In some examples, each die in the first row, e.g., die 331-1-1, may overlap 333-2 with a die in the second row, e.g., die 331-1-2, as a pair of dies. The number of such pairs of dies may be in a range of from 5 pairs to 50 pairs. A first sequence 335 of die nozzles in a first die, e.g., die 331-1-1, and a corresponding first sequence 335 of die nozzles in a paired second die, e.g., die 331-1-2, may be separated in the direction parallel to the direction of transit by a distance 336 in a range of from 3 mm to 30 mm, along with other corresponding sequences 335-1-N. The distance 336 of separation may depend upon the number of sequences 335-1-N of die nozzles in each die, among other considerations.

Individual lengths of the plurality of dies, in the direction parallel to the direction of transit, may fit within a length, e.g., as shown at 443 and described in connection with FIG. 4, of the absorbent wipe material. The absorbent wipe material, e.g., shown at 209 and described in connection with FIG. 2 and elsewhere herein, may be pressed against the dies during ejection of the droplet from the opening 338 in the subset of the plurality of die nozzles 337 being pressed against the absorbent wipe material 209. In addition to absorbing residual fluid and partially hardened fluid from the opening 338 by a capillary draw, ends and/or loops of the microfilaments, e.g., each microfilament having a diameter as low as 4 um, may extend into a bore 339 of an opening 338 to contribute to removal and/or absorption of hardened material, e.g., by dislodging the hardened material, along with contributing to removal and/or absorption of the residual and partially hardened fluid.

In various examples, the plurality of sequences 335-1-N of die nozzles in each die may correspond to a plurality of fluid colors, e.g., different colored inks for each sequence 335 of die nozzles. As such, the four sequences in each die 331 illustrated in FIG. 3 may correspond to four fluid colors. For example, the fluid colors may be black (K), cyan (C), magenta (M), and yellow (Y), although the number of fluid colors is not limited to four and/or the colors are not limited to KCMY. Accordingly, a controller, e.g., as shown at 102 and described in connection with FIG. 1, may direct transit of the absorbent wipe material 209 past a plurality of openings 338 in the plurality of die nozzles 338 in the plurality of sequences 335-1-N of die nozzles in each die, e.g., dies 331-1-1 and 331-1-2.

Droplets of the plurality of fluid colors may be ejected toward a same location of the absorbent wipe material 209. For example, a plurality of openings 338, e.g., one for each of the KCMY die nozzles at corresponding positions in the sequences 335 in die 331-2-1, may be aligned in the direction parallel to the direction of transit of the absorbent wipe material to enable at least one droplet from each to be serially ejected toward the same location during transit of the absorbent wipe material in the particular direction. Alternatively or in addition, a plurality of openings 338, e.g., one for each of the KCMY die nozzles at corresponding positions in the overlap 333-2 in sequences 335 in dies 331-2-1 and 331-2-2, may be aligned in the direction parallel to the direction of transit to enable at least one droplet from each to be serially ejected toward the same location. As used herein, to perform a function serially is intended to mean performing the function, e.g., ejecting a droplet, wiping an opening of a die nozzle with a location of an absorbent wipe material, etc., at a time that the opening and/or the droplet contacts and/or reaches, e.g., lands on, impacts, etc., the absorbent wipe material. The time for performing the function may depend on a timing, e.g., dependent on a rate, of transit of the absorbent wipe material past a particular opening.

FIG. 4 illustrates an example of droplet alignment 440 on an absorbent wipe material 209, according to the present disclosure. The upper portion of FIG. 4 illustrates an example of a result of droplets reaching the absorbent wipe material 209 when ejected simultaneously during transit of the absorbent wipe material 209 past the openings 338 in a staggered array of dies, e.g., as shown at staggered array 330 of dies 331 in printhead 312 and described in connection with FIG. 3.

As such, when there is no alignment 441 of droplet ejection relative to reaching a location corresponding to a position 443 of the compliant member, e.g., compliant member 110 shown in and described in connection with FIG. 1, a pattern may result from the droplets reaching the absorbent wipe material 209. Such a pattern of droplets reaching the absorbent wipe material 209 may form patches 445-1-1, 445-1-2, . . . , 445-3-1 on the absorbent wipe material 209 that correspond to ejecting droplets from the openings 338 of the die nozzles 337 of dies 331-1-1, 331-1-2, . . . , 331-3-1 during transit of the absorbent wipe material 209 in a particular direction 444. Subpatches 446-1-N, e.g., indicated for simplicity by being between the dotted lines in each patch 445, although the subpatches may overlap, may be formed by ejecting droplets of fluid, e.g., of a plurality different fluid colors, simultaneously for a period of time on the absorbent wipe material 209 from each opening 338 in each sequence 335 of die nozzles 337, e.g., as shown in FIG. 3.

By no alignment 441 of the droplet ejection relative to the position 443 of the compliant member, there may be a broad length 447 of the patches 445 on the absorbent wipe material 209 parallel to the direct of transit 444 relative to the narrower length at the position 443 of the compliant member 110, e.g., a length in a range of from 2 to 10 mm. Without alignment, there is a broad length 447 over which droplets from openings 338 of all dies 331 are ejected in order to have at least some of droplets correspond to the position 443 of the compliant member 110. However, without such alignment, all of the fluid colors corresponding to the subpatches 446-1-N do not reach the position 443 on the absorbent wipe material 209 corresponding to the compliant member 110. As such, an ability of the compliant member 110 to press the absorbent wipe material 209 against the openings 338 of the die nozzles 337 concurrent with ejection of the droplet therefrom may be compromised by no alignment of the fluid ejection with a location on the absorbent wipe material 209.

In contrast, the lower portion of FIG. 4 illustrates a result with alignment 442. Such alignment may result in droplets reaching the absorbent wipe material 209 when ejected serially during transit 444 of the absorbent wipe material 209 past the openings 338 in the staggered array of dies such that the droplets serially reach the location concurrently with the droplets being ejected from the respective openings. In some examples, the location may correspond to the position 443 of the compliant member 110, e.g., a same location for all the droplets corresponding to the length of the compliant member 110. In some examples, the length of the position 443 of the compliant member 110 may correspond to a plurality of locations for the droplets along the length, e.g., such that subsets of the droplets ejected during transit of the absorbent wipe material 209 past the position 443 reach each of the locations within the length of the position 443 of the compliant member 110.

As such, with alignment 442, ejection from the openings in all the nozzles of the dies, and pairs of dies, may reach the position 443 on the absorbent wipe material 209 corresponding to the compliant member 110. In addition, such alignment may reduce formation of the subpatches 446-1-N, e.g., corresponding to different fluid colors, formed when no alignment 441 is performed. For example, all fluid colors of droplets from the dies, and pairs of dies, may reach the position 443 on the absorbent wipe material 209 corresponding to the compliant member 110. The length of the position 443 of the compliant member 110 is shown in the lower portion of FIG. 4 to be white for the purpose of clarity. However, having a plurality of droplets from each ejection reach each location within the length of the position 443, e.g., when each ejection may have droplets of a different fluid color, may result in the length of the position 443 being dark rather than white. For example, a mixture of K, C, M, and/or Y fluid colors may result in the length of the position 443 being black. As such, the compliant member 110 is enabled to press the absorbent wipe material 209 against the openings 338 of the of die nozzles 337 concurrent with ejection of the droplet therefrom.

A length 448 of the patches 445-1-1, 445-1-2, . . . , 445-3-1 on the absorbent wipe material 209 may be slightly broader than the position 443 of the compliant member 110 due to, for example, timing and/or tolerance differences between ejecting of droplets from different dies 331 and/or sequences 335 of die nozzles. However, such inaccuracies may be corrected with compensatory timing adjustments.

Figure 5:
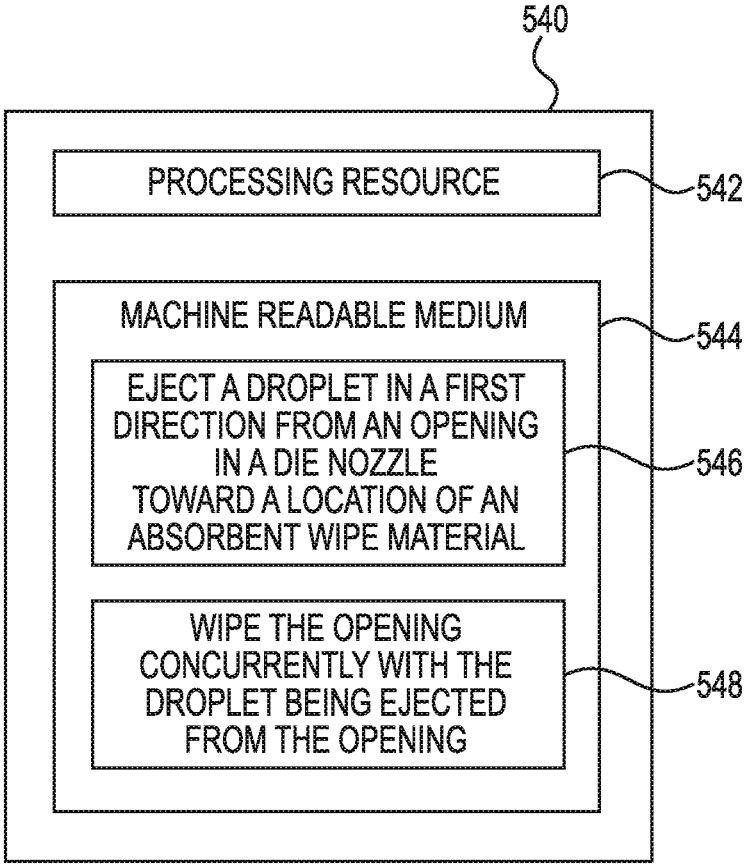
FIG. 5 illustrates a diagram of an example of a non-transitory computer readable medium and processing resource system for wiping nozzles of fluid ejection dies, according to the present disclosure.

FIG. 5 illustrates a diagram of an example system 540 that includes a non-transitory machine readable medium (MRM) 544 and a processing resource 542, e.g., a number of processors, for wiping nozzles of fluid ejection dies, according to the present disclosure. For example, the system 540 may be an implementation of the example systems of FIGS. 1-4 or the example method of FIG. 6.

The processing resource 542 may include a number of central processing units (CPUs), microprocessors, and/or other hardware devices suitable for retrieval and execution of instructions stored in the MRM 544. As an alternative or in addition to retrieving and executing instructions, the processing resource 542 may include electronic circuits including a number of electronic components for performing the functionality of one or more of the instructions in the MRM 544. With respect to the executable instruction representations described and shown herein, e.g., boxes in FIG. 5, it is to be understood that part or all of the executable instructions and/or electronic circuits included within one box may, in alternate embodiments, be included in a different box shown in the figures or in a different box not shown.

The processing resource 542 may execute instructions stored on the MRM 544. The MRM 544 may be any type of volatile or non-volatile memory or storage. The MRM 544 may be any electronic, magnetic, optical, or other physical storage device that stores executable instructions. Thus, MRM 544 may be, for example, Random Access Memory (RAM), an Electrically-Erasable Programmable Read-Only Memory (EEPROM), Flash memory, Read-Only Memory (ROM), a hard disk, a storage drive, an optical disc, and the like, or a combination thereof. MRM 544 may be disposed within system 540, as shown in FIG. 5. In this situation, the executable instructions may be "installed" on the system 540. Additionally or alternatively, the MRM 544 may be a portable, external or remote storage medium, for example, that allows system 540 to download the instructions from the portable/external/remote storage medium. In this situation, the executable instructions may be part of an "installation package".

The MRM 544 may store instructions executable by the processing resource 542. For example, the MRM 544 may store instructions 546 to eject a droplet in a first direction from an opening in a die nozzle toward a location of an absorbent wipe material. The MRM 544 also may store instructions 548 to wipe the opening concurrently with the droplet being ejected from the opening.

In some examples, the MRM 544 may store instructions to transit the location on an adjacent surface of the absorbent wipe material past the opening concurrently with the droplet being ejected from the opening and the opening being wiped by the location. The adjacent surface may be positioned substantially perpendicular to the first direction. For example, the die nozzle may be in a die in the printhead 112 shown in FIG. 1 and the droplet may be ejected from the opening in the first direction, e.g., vertically, toward the absorbent wipe material 109, which may be positioned substantially perpendicular, e.g., horizontally, to the direction of the ejected droplet.

The MRM 544 may store instructions to eject the droplet from the opening concurrently with the location on the absorbent wipe material being in contact with the opening. The MRM 544 may store instructions to eject a droplet from an opening in each of a plurality of die nozzles serially on a same location of the absorbent wipe material concurrently with the opening being wiped by the same location on the absorbent wipe material. The MRM 544 may store instructions to eject a droplet serially from each of a plurality of aligned openings, e.g., where the openings may be aligned between different sequences 335 of nozzles in a same die and/or aligned between openings of nozzles in an overlap 333 between staggered dies, toward the location of the absorbent wipe material. The MRM 544 may store instructions to transit the absorbent wipe material in a direction of alignment of the plurality of aligned openings location such that the droplet from each of the plurality of aligned openings serially reaches and is serially wiped by the same location on the absorbent wipe material.

Figure 6:
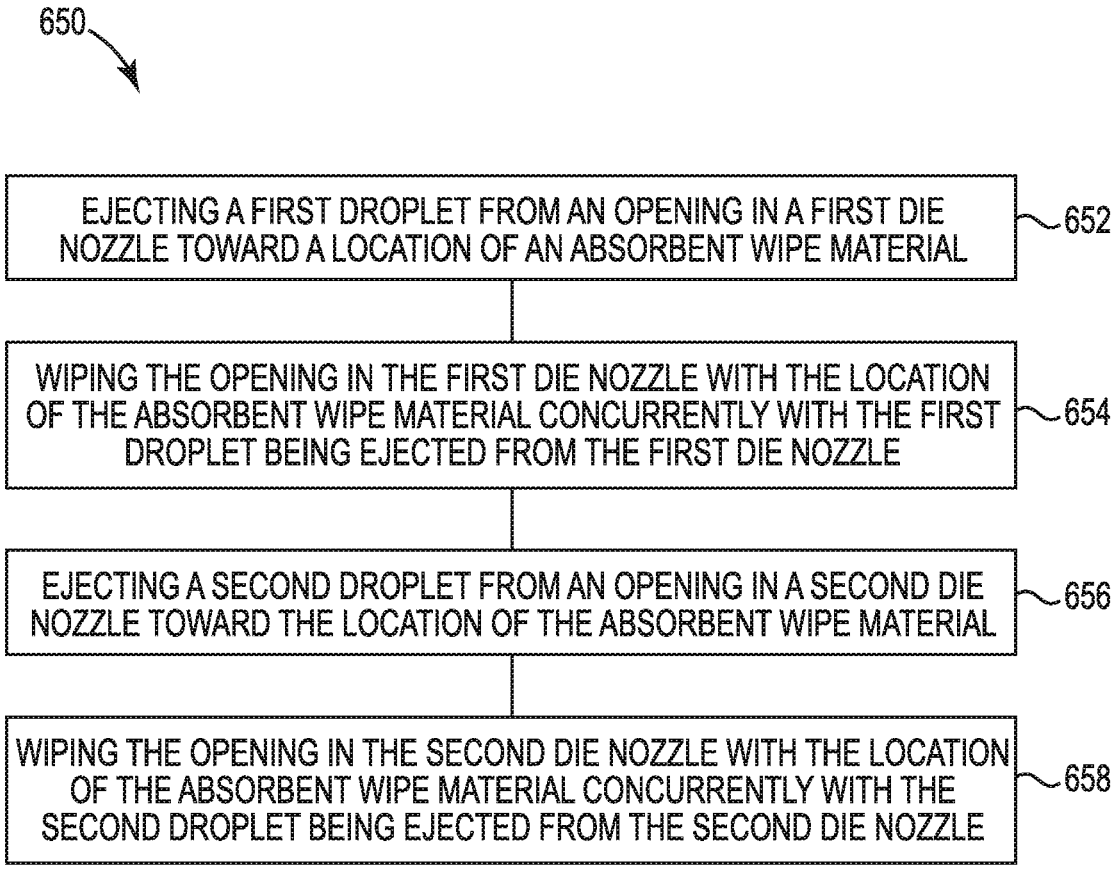
FIG. 6 illustrates an example method for wiping nozzles of fluid ejection dies, according to the present disclosure.

FIG. 6 illustrates an example method 650 for wiping nozzles of fluid ejection dies, according to the present disclosure. For example, the method 650 may be an implementation of the example systems of FIGS. 1-5. At 652, the method 650 includes ejecting a first droplet from an opening in a first die nozzle toward a location of an absorbent wipe material. At 654, the method 650 includes wiping the opening in the first die nozzle with the location of the absorbent wipe material concurrently with the first droplet being ejected from the first die nozzle. At 656, the method 650 includes ejecting a second droplet from an opening in a second die nozzle toward the location of the absorbent wipe material, e.g., the same location on the absorbent wipe material toward which the first droplet was ejected from the opening in the first die nozzle. At 658, the method 650 includes wiping the opening in the second die nozzle with the location of the absorbent wipe material concurrently with the second droplet being ejected from the second die nozzle, e.g., wiping the opening in the second die nozzle with the same location on the absorbent wipe material with which the first droplet was wiped.

In some examples, the method 650 may include transiting the absorbent wipe material past the openings in the first and second die nozzles such that the first and second droplets serially reach the location of the absorbent wipe material. In some examples, the method 650 may include ejecting the first droplet of a first fluid color from the opening in the first die nozzle, ejecting the second droplet of a second fluid color from the opening in the second die nozzle, and transiting the absorbent wipe material past the openings in the first and second die nozzles such that the droplets of the first and second fluid colors serially reach the same location of the absorbent wipe material.

In some examples, the method 650 may include staggering a first die and a second die, e.g., dies 331-2-1 and 331-2-2 in FIG. 3, to align the opening in the first die nozzle of the first die and the opening in the second die nozzle of the second die, e.g., in overlap 333-2. The method 650 may include ejecting the first droplet from the opening in the first die nozzle of the first die, ejecting the second droplet from the opening in the second die nozzle of the second die, and transiting the absorbent wipe material past the openings in the first and second die nozzles such that the droplets of the first and second dies serially reach the same location of the absorbent wipe material.

The present disclosure describes ejecting fluid from an opening of a die nozzle onto a location of an absorbent wipe material, e.g., a web, while concurrently wiping the opening. In this sequence, the opening may be ejecting fluid onto the location of the web while the opening is in contact with the location doing the wipe of the opening. This sequence may be repeatedly performed whereby the same location on the web has fluid ejected thereon a plurality of times, e.g., serially, followed by wiping the respective opening using the same location on the web, Results from performance of this sequence show a notable decrease in nozzle outages, e.g., from being blocked and/or misaligned, etc., relative to the openings of the nozzles being wiped first and subsequently having fluid ejected therefrom.

It is an unexpected result that ejecting more fluid onto an already wet web, as described herein, may reduce a possibility of, for example, introducing air defects into an opening of a die nozzle. The sequence described herein for wiping an opening of a die nozzle while ejecting fluid from the opening has an electrical potential being applied to the fluid ejector of the die nozzle. This may result in a substantially higher temperature during wiping of the opening than when wiping with no electrical potential being applied to the fluid ejector and ejecting fluid from the opening following the wipe. Thus, it is also an unexpected result that ejecting fluid onto the web using a heated opening of the die nozzle correlates with the reduction of air defects relative to a wipe of an opening of a die nozzle that has not been heated. In addition, wiping the heated nozzle may improve removal of dried fluid, e.g., ink, and/or binder residue from the opening and/or edges of the die nozzle and/or die.

The sequence described herein of ejecting fluid from the opening of the die nozzle onto a location of the web while concurrently wiping the opening with the location may have a number of advantages relative to other nozzle maintenance and/or clean operations. For example, the sequence may increase a usable time for the web material by wiping a plurality of times at a single location of the web. This increase in usable time for the web material may increase a serviced page count for the web, allow for increased frequency of wiping for better customer print quality, and/or enable a cost and/or size reduction for a same expectation of usable time for the web material, among other possible advantages.

By allowing for wetter wiping, the sequence described herein may contribute to a number of advantages. The sequence may help reduce a dried fluid, e.g., ink, residue that may block the openings in the nozzles, e.g., relative to wiping with a drier web. The sequence may enable thinner web materials to be used in order to be saturated more quickly with ejected fluid. The thinner web materials may be more compact and/or may allow for longer webs to be fitted into a particular implementation, which may result in a longer service time for the thinner web materials.

The sequence described herein may allow for a reduction of fluid, e.g., ink, usage during a nozzle maintenance and/or clean operation. For example, the volume of fluid used during the ejection of fluid from the opening onto the location of the web while concurrently wiping the opening with the location, as described herein, may be notably reduced, e.g., relative to implementations that wipe the opening of the die nozzle and subsequently eject droplets from the opening into a spittoon.

In the foregoing detailed description of the present disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can be inclusive of one or a plurality of such elements and/or features, as appropriate to the context.

What is claimed:

1. A non-transitory machine readable medium storing instruction executable by a processing resource to:

direct a printing device to:

eject a droplet in a first direction from an opening in a die nozzle toward a location of an absorbent wipe material; and wipe the opening concurrently with the droplet being ejected from the opening.

2. The medium of claim 1, including instructions to:

transit the location on an adjacent surface of the absorbent wipe material past the opening concurrently with;

the droplet being ejected from the opening; and the opening being wiped by the location; and wherein the adjacent surface is positioned substantially perpendicular to the first direction.

3. The medium of claim 1, including instructions to:

eject the droplet from the opening concurrently with the location being in contact with the opening.

4. The medium of claim 1, including instructions to:

eject a droplet from an opening in each of a plurality of die nozzles serially on a same location of the absorbent wipe material concurrently with the opening being wiped by the same location.

5. The medium of claim 1, including instructions to:

eject a droplet serially from each of a plurality of aligned openings toward the location of the absorbent wipe material; and transit the absorbent wipe material in a direction of alignment of the plurality of aligned openings location; and wherein the droplet from each of the plurality of aligned openings serially reaches and is serially wiped by a same location on the absorbent wipe material.

6. A system, comprising:

a plurality of die nozzles of a printhead, each die nozzle having an opening to eject a droplet;

an absorbent wipe material; and a controller to direct:

ejection of a droplet from the opening in each of the plurality of die nozzles toward a location of the absorbent wipe material;

a wipe of the opening in each die nozzle by the location concurrently with the droplet being ejected from the opening; and transit of the location past the opening in each die nozzle as the droplet is ejected from the opening.

7. The system of claim 6, wherein the droplet is at the location at a time that the opening is wiped by the location.

8. The system of claim 6, further comprising:

a sled and a sled drive motor to transit the absorbent wipe material past the printhead; and a compliant member associated with the sled to press a length of the absorbent wipe material against the printhead, the length being in a direction parallel to a direction of transit of the absorbent wipe material past the plurality of die nozzles; and wherein;

the length is in a range of from two millimeters (mm) to 10 mm; and the location is within the length.

9. The system of claim 6, wherein:

the absorbent wipe material is a web of hydro-entangled microfilaments;

the hydro-entangled microfilaments have a diameter in a range of from 4 micrometers (um) to 15 um;

the hydro-entangled microfilaments are a mixture of polyamide and polyester microfilaments; and a width of the web, perpendicular to a direction of transit of the absorbent wipe material past the plurality of die nozzles, corresponds to a width of the plurality of die nozzles of the printhead.

10. The system of claim 6, wherein:

the printhead comprises an array of a plurality of dies on a plane, each die including a subset of the plurality of die nozzles;

the plurality of dies extends in a plurality of rows in a direction perpendicular to a direction of transit of the absorbent wipe material past the plurality of die nozzles such that:

an end of a first die in a first row overlaps with a first end of a second die in a second row in a direction parallel to the direction of transit;

a second end of the second die overlaps with an end of a third die in the first row in the direction parallel to the direction of transit; and individual lengths of the plurality of dies, in the direction parallel to the direction of transit; fit within a length of the absorbent wipe material pressed against the dies during ejection of the droplet from the opening in the subset of the plurality of die nozzles.

11. The system of claim 10, wherein:

the printhead comprises an array of a plurality of dies staggered on a plane, wherein each die includes a plurality of die nozzles;

the plurality of die nozzles is positioned in a plurality of sequences of the die nozzles;

the plurality of sequences corresponds to a plurality of fluid colors; and the controller further directs:

transit of the absorbent wipe material past a plurality of openings in the plurality of die nozzles in the plurality of sequences;

droplets of the plurality of fluid colors are ejected toward a same location of the absorbent wipe material; and wherein the plurality of openings is aligned in a direction parallel to a direction of transit of the absorbent wipe material.

12. A method, comprising:

ejecting a first droplet from an opening in a first die nozzle toward a location of an absorbent wipe material;

wiping the opening in the first die nozzle with the location of the absorbent wipe material concurrently with the first droplet being ejected from the first die nozzle;

ejecting a second droplet from an opening in a second die nozzle toward the location of the absorbent wipe material; and wiping the opening in the second die nozzle with the location of the absorbent wipe material concurrently with the second droplet being ejected from the second die nozzle.

13. The method of claim 12, further comprising:

transiting the absorbent wipe material past the openings in the first and second die nozzles such that the first and second droplets serially reach the location of the absorbent wipe material.

14. The method of claim 12, further comprising:

ejecting the first droplet of a first fluid color from the opening in the first die nozzle;

ejecting the second droplet of a second fluid color from the opening in the second die nozzle; and transiting the absorbent wipe material past the openings in the first and second die nozzles such that the droplets of the first and second fluid colors serially reach the location of the absorbent wipe material.

15. The method of claim 12, further comprising:

staggering a first die and a second die to align the opening in the first die nozzle of the first die and the opening in the second die nozzle of the second die;

ejecting the first droplet from the opening in the first die nozzle of the first die;

ejecting the second droplet from the opening in the second die nozzle of the second die; and transiting the absorbent wipe material past the openings in the first and second die nozzles such that the droplets of the first and second dies serially reach the location of the absorbent wipe material.

* * * * *